United States Patent [19]

Lamy

[11] 4,202,647

[45] May 13, 1980

[54] BUOYANT BASE FOR MARINE PLATFORMS

[76] Inventor: Jacques E. Lamy, 6 rue d'Estienne d'Orves, Fontenay-Aux-Roses, France, 92260

[21] Appl. No.: 909,682

[22] Filed: May 25, 1978

Related U.S. Application Data

[63] Continuation of Ser. No. 771,342, Feb. 23, 1977, abandoned.

[30] Foreign Application Priority Data

Mar. 22, 1976 [FR] France ..... 76 08181

[51] Int. Cl.[2] ..... F02B 17/00

[52] U.S. Cl. ..... 405/203; 405/14; 405/209

[58] Field of Search ..... 405/11, 13, 14, 195, 405/203–209, 211; 114/264, 266

[56] References Cited

U.S. PATENT DOCUMENTS

| | | | |
|---|---|---|---|
| 457,438 | 8/1891 | Hunt | 405/203 |
| 1,560,880 | 11/1925 | Tromanhauser | 405/205 |
| 3,464,212 | 9/1969 | Yamagata et al. | 405/204 |
| 3,693,361 | 9/1972 | Koehler | 405/209 |
| 3,710,579 | 1/1973 | Killmer et al. | 405/11 |
| 3,871,181 | 3/1975 | DeLong | 405/11 |

FOREIGN PATENT DOCUMENTS

| | | | |
|---|---|---|---|
| 2253380 | 6/1975 | France | 405/207 |

*Primary Examiner*—David H. Corbin
*Attorney, Agent, or Firm*—Wigman & Cohen

[57] ABSTRACT

The open infrastructure of a marine platform-support is made water-tight on at least a part of its height by means of removable elements. These elements are placed between the vertical columns of the support, forming a cylindrical or lobed screen.

19 Claims, 17 Drawing Figures

BUOYANT BASE FOR MARINE PLATFORMS

This is a continuation of application Ser. No. 771,342, filed Feb. 23, 1977, now adandoned.

BACKGROUND OF THE INVENTION

The present invention concerns a method for making the open infrastructure of a marine platform buoyant during its conveyance from the builder's yard to the place where it will be immersed and during this immersion-operation.

Marine platforms, those for example which are used for subaquatic oil exploitation, are built close to the shore, at first in a dry dock so that a base for example, a caisson can be erected, and the beginnings of columns, and then on open water in a sheltered site, where the superstructure can be finished during a progressive immersion. Once the construction is finished and the platform put in place, the whole construction is towed to the place provided for its installation, where it is ballasted or immersed by other means and secured on the marine bottom.

During these two phases, on the one hand the towing and the putting in place and on the other hand the full-time utilisation of the platform, the support-structure is subjected to very different and often contrary constraints. During the first phase, the emphasis will be put on good buoyancy of the whole while subsequently it will be good resistance to swell and to bad weather in general which will be the predominant problem.

It is evident that in both phases the structural solidity of the platform will be an essential condition so much so that it will not be an issue subsequently, the constructions envisaged herein are considered to answer the demands for rigidity and durability in all situations, conditions which are now well known in the art.

Among these demands, there is however one in particular that must be raised here; it concerns the resistance of the support-part of the platform which is most exposed to the waves of a swelling sea. On the high seas, the constraints undergone by the infrastructure will be very important and means have already been studied and put into practice which are capable of resisting the strongest swells.

Among these solutions, it has proved particulalry advantageous to mount the platform on a hollow central column surrounded on the periphery by very tall columns, possibly suitably wind-braced. The protection of the structure can take the form of a wall pierced by numerous holes, in particular in the part most exposed to the swell; this wall can also be replaced by annular baulks suitably spaced and intersected with the columns. In the two cases, the exterior structure is normally connected by cross-bars to the hollow central column.

These structures are very interesting from the hydrodynamic point of view, but in order for buoyancy to be achieved, the hollow central column must have had sufficient diameter to be able to serve as floats during towing. Now, after the putting the platform in place, the volume of the interior space of the central column was to a great extent unutilised, the pipe-lines and other useful parts normally passing by this funnel occupying only a small part.

To be able to reduce the diameter of this column to a minimum which is necessary to support the central part of the platform and to allow a passage proportioned to the operational use which is made of it, it was necessary to find another way of increasing the buoyancy of the whole. The problem was equally posed in the case of structures which did not comprise a central column. The aim of obtaining good buoyancy is achieved by the formation of a removable envelope which temporarily surrounds the columns supporting the platform.

SUMMARY OF THE INVENTION

According to the invention, the method for creating or for increasing the buoyancy of the open support-structure of a marine platform consists of making the structure watertight on at least a part of its height by means of removable elements.

According to one solution, the peripheral vertical columns of the structure supporting the platform are surrounded in its entirety by a screen formed of removeable panels connected above its edges in the manner of pile planks.

These removable panels can also be placed between the peripheral vertical columns of the structure supporting the platform.

If in the first instance the screen constituted by these removeable elements presents a cylindrical surface, in the second instance the screen can be lobed, that is to say presenting between two support columns an arc of circle whose radius is less than that of the cylindrical screen.

For structures of great dimensions, in particular of a great height, it is logical to provide intermediary horizontal boards, which may also be constituted of removeable elements, these boards forming, with a partial cylindrical screen, a caisson which can be placed for example at the level which the water reaches on the immersed structure.

The elements used for the formation of the screens can be rectangular or square panels having two adjacent sides grooved to constitute pile planks.

Caissons can also be used in the form of staves having sections which present what approximates a segment of crown; the small sides can also present a profile which allows the engagement of two contiguous surfaces.

During the towing and the immersion of the structure, the removeable elements are normally surrounded on the whole periphery of the structure with hard steel cables contained in sheats. Precautions are taken to facilitate the cutting of the cables under water at the end of the immersion.

The description which follows, as regards the drawings attached, given by way of non-limiting example, will make quite clear how the invention can be realised, the particularities which belong to the drawings as much as to the text forming, of course, are of the said invention.

DETAILED DESCRIPTION OF PREFERRED EMBODIMENT

The first example, illustrated by FIGS. 1 to 13, concerns a structure not necessarily comprising a central column.

Figure 1:
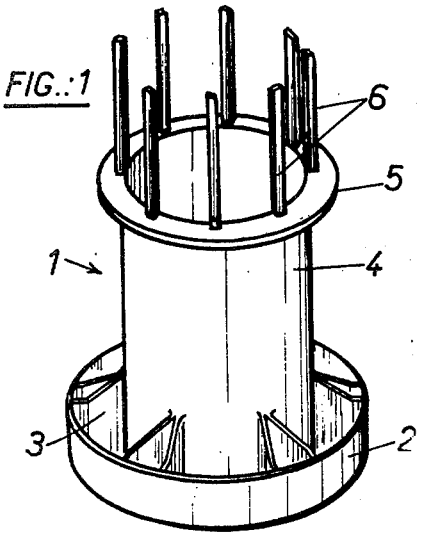
FIG. 1 represents in perspective the base of the immersible structure according to a first embodiment.

In a first stage the base 1 represented in FIG. 1 is built in a dry dock. Its foot is surrounded by a protectionwall 2, which can be supplied with a known device to protect it from undermining, this wall being connected by radial crossbars 3 to a solid wall 4 whose height is adapted to the particular conditions of the situation. This continuation rests on a bed (not illustrated) and thus constitutes a buoyant caisson. The solid wall 4 terminates towards the top in a console 5 which serves to consolidate the upper extremity of the wall 4, especially if this is relatively thin, but which, in the embodiment which will be subsequently described, has yet another role to play. Beginnings of columns 6 are also built in the extension of the solid wall 4 while the whole is still lying dry. This part of the structure, up to and including the console, is intended to be permanently positioned under the water.

When the base structure has reached a certain height, the dock is filled up with water, it is towed into deeper but calm water, where the construction of the columns 6 continues while the central part is ballasted and sinks slowly into the water.

When the console 5 approaches the level of the sea, there is a risk of the water rushing into this central hole, by successive waves at first, then by total inundation, unless the circumferential solid wall reaches such a height that the columns only correspond to the difference between trough and crest of the stongest swell which might be anticipated. In this instance however because of the weight of the platform which makes the center of gravity of the whole go up again, towing remains a delicate operation.

Figure 2:
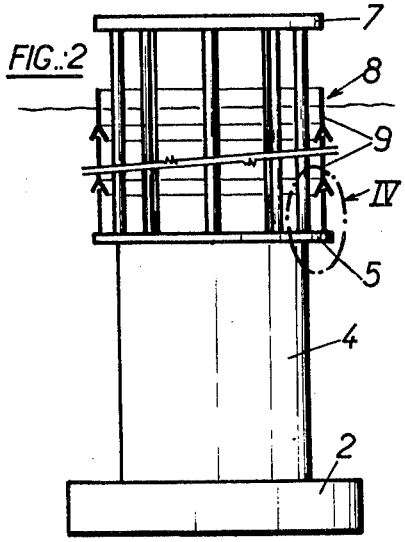
FIG. 2 represents a side view of the structure according to FIG. 1.

FIG. 2 represent in schematic form the solution of these problems by the method according to the invention. The console 5 which surrounds the upper edge of the solid wall 4 carries a screen of pile planks 8 which surrounds the columns 6 placed on the perpendicularity of the wall 4 and which support the platform 7.

Figure 3:
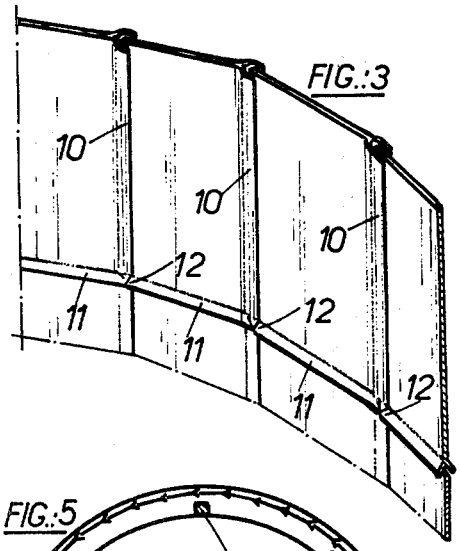
FIG. 3 represents on an enlarged scale a part of the screen ensuring water-tightness formed by elements in the form of panels.
Figure 4:
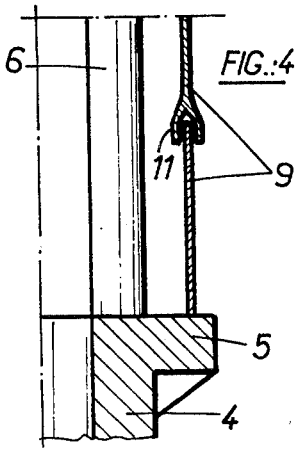
FIG. 4 represents, on an enlarged scale in section, a detail of the circled portion IV shown on FIG. 2.

The screen of pile planks 8 is composed of elements 9, rectangular in this example, which includes a vertical edge 10 and the lower horizontal edge 11 each of which comprises a rim which fits interfits with an edge of a neighbouring element 9; or perhaps better seen in the detail of FIG. 3. To obtain normal water-tightness of this assembly a special stopper 12 must still be provided at the intersection of two rims, for example in the form of a rubber joint which is forcibly introduced into the square hole remaining open; even if this device was meant to be of only a relative efficacity, the penetration of water by this route is of secondary order and, even in the least favourable instance, it is easily controlled by the pumps which regulate the ballasting of the whole.

Figure 5:
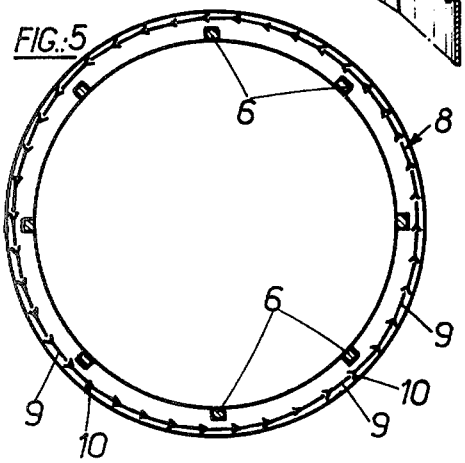
FIG. 5 represents a section of a first embodiment of the structure according to the present invention having a cylindrical screen ensuring water-tightness.
Figure 6:
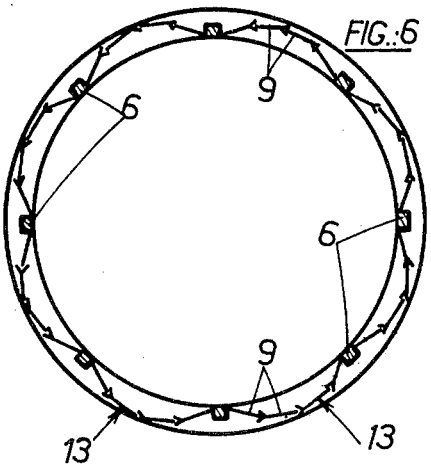
FIG. 6 represents a section of a first embodiment of the structure according to the present invention with a lobed screen ensuring water-tightness.

The screen of pile planks 8 can be circular, as is shown in FIG. 5 and surround the columns 6; but it can also be lobed (FIG. 6) and be composed of segments 13 composed of several juxtaposed elements 9 buttressed on two neighbouring columns 6. With these different solutions, utilising a screen of pile planks, the flat elements can be disengaged and remounted one by one. It is only necessary that the height of these elements be such that they can, to be freed, pass beyond the upper edge of the screen without knocking against the lower face of the platform. One can however provide on this lower face a system of hoisting, carried on rails, intended to facilitate this handling.

If, for any reason, one cannot take out the pile planks in the way provided for above, for example because one wishes to reduce to the minimum the free space between the edge of the screen and the bottom of the platform, one can make a wall-screen by means of pseudo-pile planks formed by caissons in the form of staves.

The caissons 14 (FIG. 7 and 8), which can be formed of concrete or of metal are put in place in the same way as the flat elements 9 of pile plank. During the immersion of the structure, the pressure of the water exerts a concentric pressure on the exterior incurved faces 15 of the staves, which causes a contraction of the neighbouring side faces 16 and thus a good water-tightness is obtained by the vertical joints which can be still improved by the addition of flat joints supplied with rims. Water-tightness by horizontal joints can be obtained by the placing of suitable "beds" of elastomer; it is a matter of classic flat joints utilised in the construction of concrete caissons.

During the towing, the assembly of the staves constitutes a drum-circular or lobed according to the circumference of the structure—which must be solid enough to bear the oscillations of the assembly under the effect ot the swell. For this reason, it is girdled at different heights, for example following the usual techniques of the prestressing of concrete structures, that is to say by means of hard steel cables contained in sheaths. Provision for their loosening by the leaving of free pieces to facilitate their cutting by oxygen.

The dismantling can be effected by the sliding of the staves on the console 5 of the solid wall 4 and tipping them into the water. The stakes-caissons can be provided in the interior of bulkheads to avoid all accident from submersion.

Figure 9:
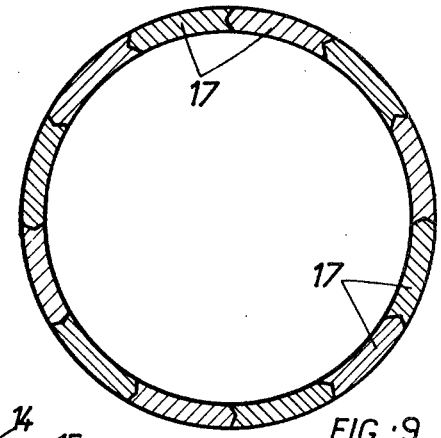
FIGS. 9 and 10 represent sections of cylindrical screens of caissons whose side faces are drawn in section.
Figure 10:
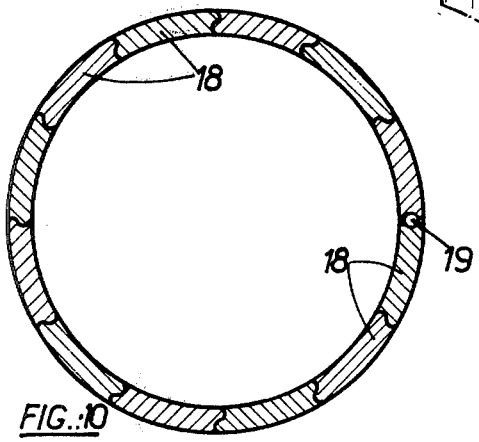

The section of the caissons presents two arcs of concentric circles connected by two convergent side faces whose extensions intersect at a distance to the arcs of circles which is less or at most equal to the radius of the latter. The angle formed by these two faces will be normally a function of the coefficient of the friction between the caissons or between the caissons and the columns of which they rest. To increase the solidity of the wall, one can adopt caissons whose side straight faces are profiled like pile plank systems. FIGS. 9 and 10 give examples of this the lateral sides of the staves 17 in the first instance are split into two plane surfaces forming in relation to one another an obtuse angle; the lateral sides of the staves 18 have a section in the form of the letter S. These profiles ensure a damming in the centripetal sense; the staves can be run together in the same way as the pile planks, and one can possibly provide girdlings like those described above.

On the other hand, one can supply a stave-key 19, which can be realised in several superposed pieces and which can have any section.

If one wants to obtain water-tightness by pressure of the staves one against the other, it is necessary to supply a sufficiently great angle between the sides of the staves, whether there are profiles or not. In this way, one can also obtain a simple dismantling without friction; indeed when the level of the water is level at the two sides of these staves at the end of the setting in place, the staves can be disengaged radially and manoeuvred by crane and/or, if need arises, by floating.

Figure 7:
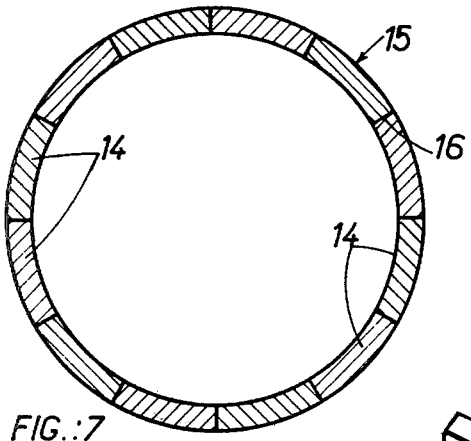
FIG. 7 represents a section of a cylindrical screen ensuring water-tightness formed with caissons.
Figure 8:
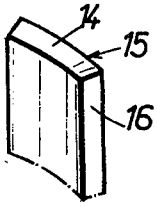
FIG. 8 represents a view in perspective of a caisson used in the formation of the screen according to FIG. 7.
Figure 11:
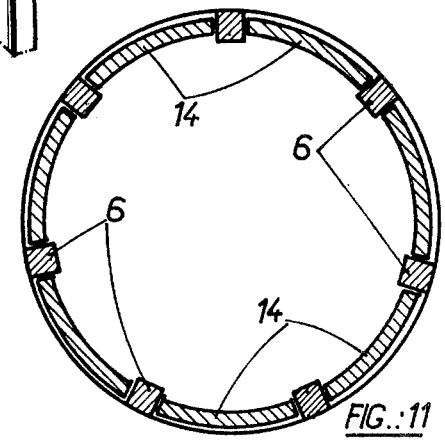
FIGS. 11 to 13 represent different combinations of caissons and columns.
Figure 12:
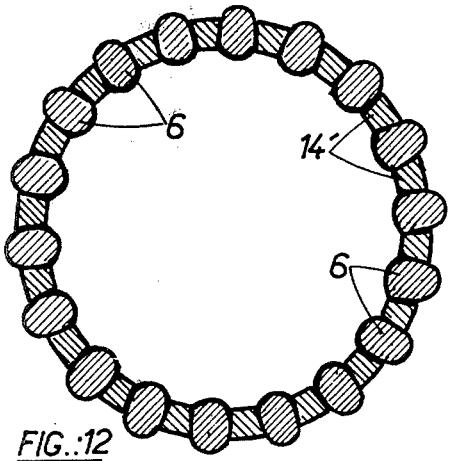
Figure 13:
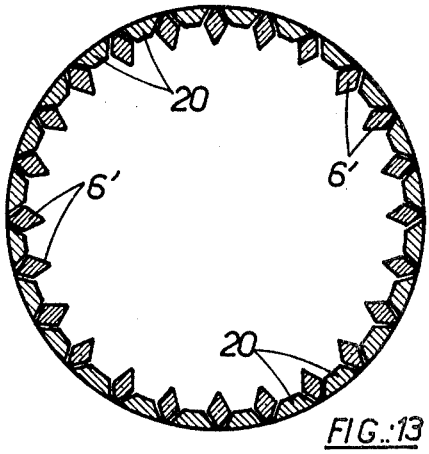

Another possibility of using staves for the formation of a buoyant structure is illustrated by FIGS. 11 to 13; in the first of these illustrations (FIG. 11) the width of the staves 14, like those illustrated by FIGS. 7 and 8, is equal to the space between the two columns 6; these columns can be brought closer together (FIG. 12), for example in the part exposed to the swell; in this instance the dimensions of the staves 14' are more reduced. Finally the columns can have sections 6' in rhombus (FIG. 13); in this instance the staves 20 present a trapezoidal horizontal section, the small side being turned towards the interior.

As yet, the realisations of structures has only concerned structures requiring a certain number of columns 6 supporting the platform 7 and resting on a solid wall 4. But is is equally possible to connect these columns 6 together by oblique struts 21 and horizontal struts 22, whether the columns rest on the console 5 of a solid wall 4 (FIG. 14) or on the bottom of a caisson 23 (FIG. 15). It is evident that in this type of construction the screen of pile planks will be easier to utilise than staves.

There must fianlly be considered the use of a central hollow column 24 whose diameter can be very different from one structure to another, the tendency being however for it to be reduced to the strict minimum through the fact that the buoyancy which was mostly obtained through this element can now be obtained by a realisation according to the present invention.

Figure 14:
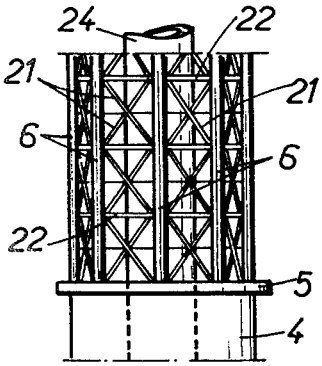
FIGS. 14 and 15 represent a second embodiment of the immersed structure according to the present invention.
Figure 15:
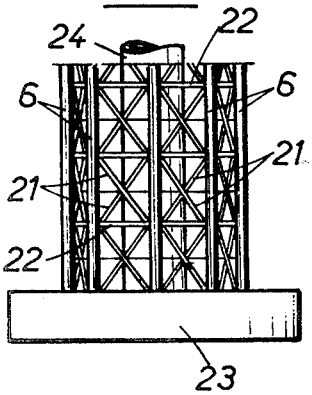

Thus the structures illustrated by FIGS. 14 and 15 can allow for such a hollow column 24, which, if required, can be connected to the exterior treillis by struts.

Figure 16:
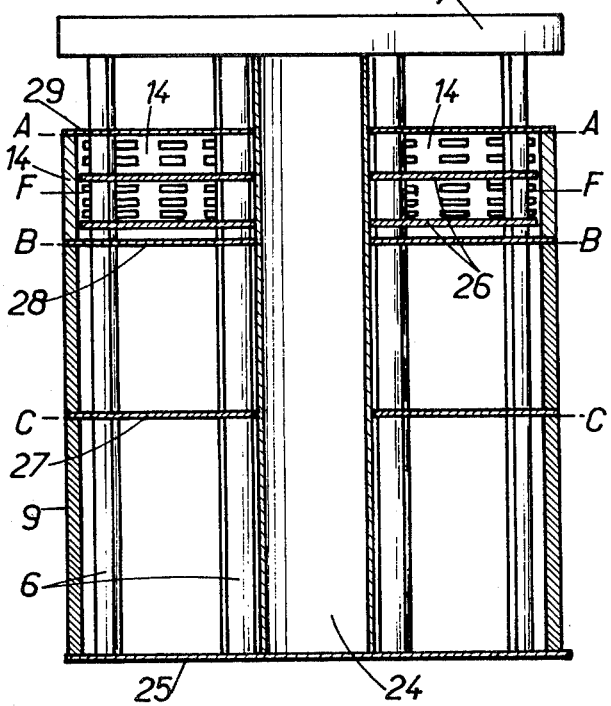
FIG. 16 represents a third embodiment of the structure according to the present invention.
Figure 17:
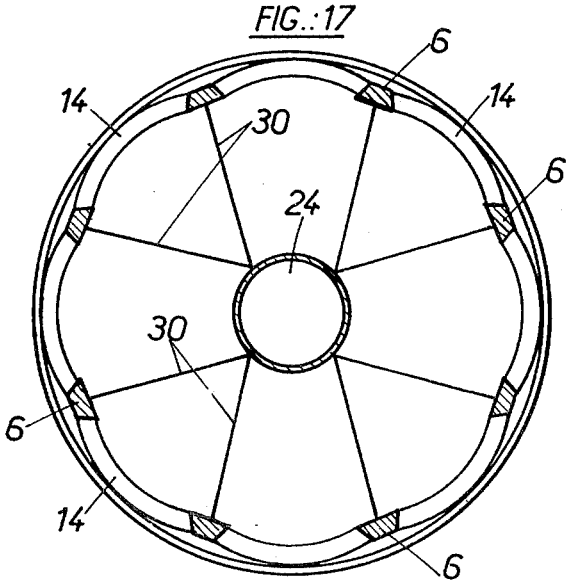
FIG. 17 represents an orthogonal section of the structure according to FIG. 16 and taken along the line AA.

Finally, FIGS. 16 and 17 represent a more complex structure of considerable dimensions, the total height possibly exceeding 100 meters and the diameter of the platform 7 possibly reaching 70 meters. The figures are obviously not intended to give precise proportions of the different elements and in order not to overcomplicate the drawing, the representation is restircted to a base 25 substantially horizontal not taking into account the devices which could be envisaged to protect this part of the structure. On the periphery of the base 25 are mounted a considerable number of columns 6 having a relatively small section which support the periphery of the platform 7, while the hollow central column 24 can extend from the bottom 25 up to the platform 7 to contribute to its support, but it can also stop at an intermediate height.

The anti-swell device which is utilised in this instance is formed by horizontal curved baulks 26 which connect the vertical columns 6 together. The radial thickness of these baulks can be the same as those of the columns or else the exterior face of the first can exceed that of the second.

To obtain the buoyancy of this structure whose total volume can be considerable, one can proceed in different ways.

According to a first solution, the columns 6 will be surrounded over their whole height, that is to say from the bottom up to the level B—B of a screen of pile planks, the openings created by the intersections of the columns 6 and the curved baulks 26 can be plugged for example by staves. If the dimensions indicated above are reached, it is to be feared however that the waterline F—F will be placed too low in relation to the center of gravity of the whole.

For this reason, it proves advantageous to place the horizontal planking at different levels of the structure, while adapting their distribution to the particular conditions of each specific instance. One can provide also a first boarding 27 at the level C—C, the columns being overlapped between this level and the bottom by a screen of pile planks 9 as has been indicated above, forming thus a base caisson. A second boarding 28 will be established at the level B—B of the lowest horizontal curved baulk 26, and the openings between the horizontal baulks 26 on the one hand and the columns 6 on the other hand are plugged by the staves 16 each of which corresponds exactly to the free space. According to the situation, one could place another planking 29 at the level A—A or else provide a screen of pile planks above this level to prevent all arrival of water over the top of the anti-swell device.

Finally, to increase the stability of the construction, one can provide struts which connect the peripheral columns 6 to the hollow central column 24 as is indicated in a very schematic fashion in FIG. 17.

I claim:

1. A method for transporting a marine platform structure from a land-like site to a deep water location, comprising the steps of:

a. initially constructing on said land-like site said marine platform structure comprising a base adapted to be secured to the underwater site, said base including a horizontal upper surface, a plurality of structural vertical columns forming an open structure which extends from said base upper surface for supporting said platform thereon;

b. temporarily rendering said base buoyant for towing by securing a plurality of removable elements about said structural members to form a continuous, watertight wall which cooperates with said base, said removable elements comprise panels which engage said base upper surface and extend upwardly to a distance above the water level;

c. towing the resulting buoyant structure over water to a preselected location where the platform structure is to be positioned;

d. immersing the support structure below the water level; and e. removing the panels from the support structure.

2. The method of claim 1 wherein said removable elements are positioned between the vertical columns.

3. The method of claim 1 wherein said removable elements being positioned in spaced relationship to the vertical columns.

4. The method of claim 1 wherein said vertical columns are positioned in a circle and said removable elements are positioned over a circle which passes through the vertical columns of the open support structure.

5. The method of claim 1 wherein said vertical columns are positioned in a circle and said removable elements are placed in an arc of circle passing through adjacent vertical columns of the open support structure and whose center is between the center of the circle passing through the vertical columns and this circle itself.

6. The method of claim 1 wherein each of the removable elements includes an edge portion which is profiled to interfit a next adjacent element having an edge profiled to correspond thereto.

7. The method of claim 1 including the step of initially constructing the marine platform on a land-like surface prior to being towed over water to the desired location for use.

8. The method of claim 7 including the step of surrounding the positioned removable elements with securing cables prior to towing the buoyant marine platform to the desired water location.

9. The method of claim 8 including the step of removing the securing cables and the removable elements after the marine platform is secured at the desired location.

10. The method of claim 1 wherein the removable elements are caissons in the form of staves.

11. The method of claim 1 wherein the removable elements are square or rectangular pile planks having adjacent edges formed with cooperating groups.

12. A marine platform structure capable of being transportable from a land-like site to a deep water location comprising:

a base constructed to be secured to an underwater site, said base including a horizontal upper surface;

a plurality of vertical structural members forming an open structure which extends from said base upper surface, platform means supported by said vertical structural members and adapted to extend above the water level; and a plurality of removable elements including means for forming a continuous watertight wall which cooperates with said base for rendering said platform structure buoyant and towable over water, said removable elements comprise panels which engage said base upper surface and extend upwardly to a distance above the water level.

13. The platform structure according to claim 12 wherein said vertical members are positioned in circle and said removable elements are positioned substantially on a circle which passes through the peripheral vertical members.

14. The platform structure according to claim 12 wherein said vertical members are positioned in a circle and said removable elements are positioned substantially on an arc of circle passing though two neighboring vertical members and whose center is placed between the center of the circle passing through vertical members and the circle itself.

15. The platform structure according to claim 12 wherein said removable elements include profiled surfaces for interengagement with each other.

16. The platform structure according to claim 15 wherein at least one of the interengaging surfaces of one of said removable elements is bifurcated to receive therein a next adjacent removable element.

17. The platform structure according to claim 12 wherein said removable elements are in the form of staves.

18. The platform structure according to claim 12 wherein said removable elements are in the form of a segment of a crown.

19. The platform structure according to claim 12 further including cable means surrounding said removable elements at its periphery.

* * * * *